US008043171B2

(12) United States Patent
Huffman et al.

(10) Patent No.: US 8,043,171 B2
(45) Date of Patent: Oct. 25, 2011

(54) GOLF SWING AID

(76) Inventors: Dennis Huffman, Bonita Springs, FL (US); Colby Huffman, Jacksonville, FL (US)

( * ) Notice: Subject to any disclaimer, the term of this patent is extended or adjusted under 35 U.S.C. 154(b) by 0 days.

(21) Appl. No.: 12/400,605

(22) Filed: Mar. 9, 2009

(65) Prior Publication Data

US 2009/0239674 A1 Sep. 24, 2009

Related U.S. Application Data

(60) Provisional application No. 61/034,542, filed on Mar. 7, 2008.

(51) Int. Cl.
*A63B 69/36* (2006.01)

(52) U.S. Cl. ..... 473/409; 473/213

(58) Field of Classification Search ..... 473/201, 473/206, 207, 212, 213, 298, 551, 409
See application file for complete search history.

(56) References Cited

U.S. PATENT DOCUMENTS

| | | | | | |
|---|---|---|---|---|---|
| 739,450 | A | * | 9/1903 | Schnek | 473/551 |
| 742,004 | A | * | 10/1903 | Carnegie | 473/205 |
| 2,234,638 | A | * | 3/1941 | Topping | 473/206 |
| 2,273,416 | A | * | 2/1942 | Norwood | 473/206 |
| 3,249,359 | A | | 5/1966 | Goldberger | |
| 3,725,957 | A | | 4/1973 | Shotmeyer | |
| 3,819,177 | A | * | 6/1974 | Spiro | 482/122 |
| 4,239,228 | A | | 12/1980 | Norman et al. | |
| 4,273,336 | A | * | 6/1981 | Larkey | 473/213 |
| 5,248,146 | A | | 9/1993 | Viets et al. | |
| 5,294,126 | A | | 3/1994 | Armstrong, III | |
| D353,172 | S | * | 12/1994 | Gaut | D21/692 |
| 5,447,312 | A | | 9/1995 | Nixon et al. | |
| 5,470,073 | A | | 11/1995 | Vasquez | |
| 5,501,464 | A | | 3/1996 | Dalbo | |
| 5,614,300 | A | * | 3/1997 | Cicali et al. | 482/122 |
| 5,711,716 | A | | 1/1998 | O'Brien et al. | |
| 5,711,747 | A | * | 1/1998 | Steinback | 482/124 |
| 5,851,156 | A | | 12/1998 | Schwark, Jr. | |
| 5,945,060 | A | * | 8/1999 | Williams | 264/564 |
| 6,508,721 | B1 | * | 1/2003 | Kriser | 473/298 |
| 6,537,160 | B2 | | 3/2003 | Chrystal | |
| 6,719,639 | B2 | | 4/2004 | Novosel, Sr. | |
| 6,805,640 | B2 | | 10/2004 | Kim et al. | |
| 6,857,970 | B2 | | 2/2005 | Robbins | |
| 2004/0067827 | A1 | * | 4/2004 | Tustin | 482/121 |
| 2008/0119299 | A1 | | 5/2008 | Merrill | |

* cited by examiner

*Primary Examiner* — Nini Legesse
(74) *Attorney, Agent, or Firm* — Emily E. Harris; Kent A. Herink

(57) ABSTRACT

A golf swing aid is provided which keeps the wrists in close proximity during a golf swing. The aid wraps around one or both of a golfer's wrists, and may be wrapped around the club. The aid is divided into distinct regions which inform the golfer of whether the swing will result in a square shot, a hook shot, or a slice.

12 Claims, 3 Drawing Sheets

GOLF SWING AID

This application claims priority to U.S. Provisional Patent Application No. 61/034,542 filed Mar. 7, 2008, and herein incorporates the provisional patent application by reference.

BACKGROUND OF THE INVENTION

1. Field

The present invention relates to a device to improve a golf swing, and more particularly, to a device that holds wrists in close proximity and helps a golfer identify whether the golf club position will result in a hook, slice or square shot.

2. Background

It is important that golfer's wrists stay close together during a swing in order to maximize control over the swing. Further, it is difficult for a golfer to determine, just by looking at his/her wrists when lining up the shot and swinging, whether the hands, wrists, and forearms are aligned to result in a hook shot, a slice, or a square shot. A square shot, or a shot that follows the straight line of the shot, is generally desired. Misplayed shots include a hook shot, wherein the shot moves severely from right to left (or left to right for a left-handed player). Another type of misplayed shot is a slice, where the shot moves severely from left to right (or right to left for a left-handed player).

Several complicated golf swing training devices are disclosed in the prior art. For example, U.S. Pat. No. 6,857,970 to Robbins describes a golf training apparatus configured to aid a golfer in developing a consistent golf swing. The Robbins device includes a large triangle plane guide a shaft coupler, and a limb attachment member. The device appears quite large, and somewhat complicated to attach to the golfer. Similarly, the device described in U.S. Pat. No. 5,711,716 to O'Brien includes a pair of arm members, connected by an extended support member. This device is also large and complex.

Other golf swing aids require a third party to observe the swing and the device in order to correct the swing. For example, U.S. Patent Application Pub. No. 2008/0119299 to Merrill describes a device to be inserted between the golfer's forearms during the swing. The device includes color regions to be observed during the course of the whole swing: both color regions are visible when aligning with the ball, swinging the club backwards until only one color region is visible, and then swinging the club until only the second region is visible. These color regions can only be observed by a third party, or recorded and then played back. The golfer cannot observe the color regions on his or her own during the course of the swing; a third party observer is required.

Therefore, there is a need in the art for a method and apparatus for improving a golfer's swing that is simple, small and easily carried, and capable of being used without a third party. Improvements to the golfer's swing should include maximizing control over the swing by keeping the wrists together, and helping the golfer line up the club face as desired to accurately place the ball.

SUMMARY OF THE INVENTION

The object of the present invention is to provide a golf training aid that helps a player maximize control over the shot.

A further object of the present invention is to provide a golf training aid that can be used by an individual, without the need for an additional observer or trainer.

Another object of the present invention is to provide a golf training aid that is portable and easy to use.

An additional object of the present invention is to provide a golf training aid that identifies whether the player has lined up a square shot, or if the shot is lined up to hook or slice.

These and other objects of the present invention will become apparent to those skilled in the art upon reference to the following specification, drawings, and claims.

The present invention intends to overcome the difficulties encountered heretofore. To that end, an improved golf swing aid is provided.

FIG. **6*a*** is a view of a use of the golf swing aid of the present invention.

FIG. **6*b*** is a view of a use of the golf swing aid of the present invention.

DETAILED DESCRIPTION OF THE INVENTION

Figure 1:
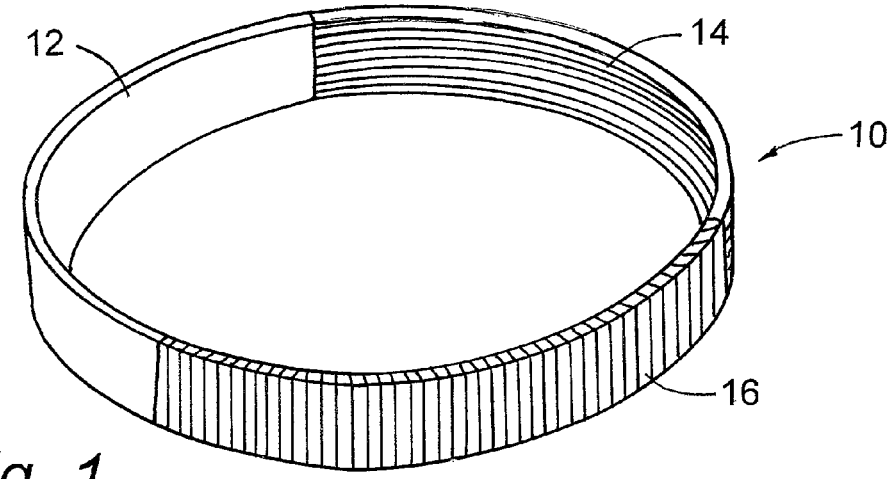
FIG. 1 is a perspective view of the golf swing aid of the present invention.

The golf swing aid 10 is shown in FIG. 1. The aid 10 is a band 10 that wraps around a golfer's wrists 20, 22 during a golf swing, golf chip, or putting stroke. The aid 10 comprises one continuous band 10 to be wrapped around one or both wrists, and may also be wrapped around the golf club 24. The band 10 is made from an elastic material, and most typically is made from rubber.

Figure 2:
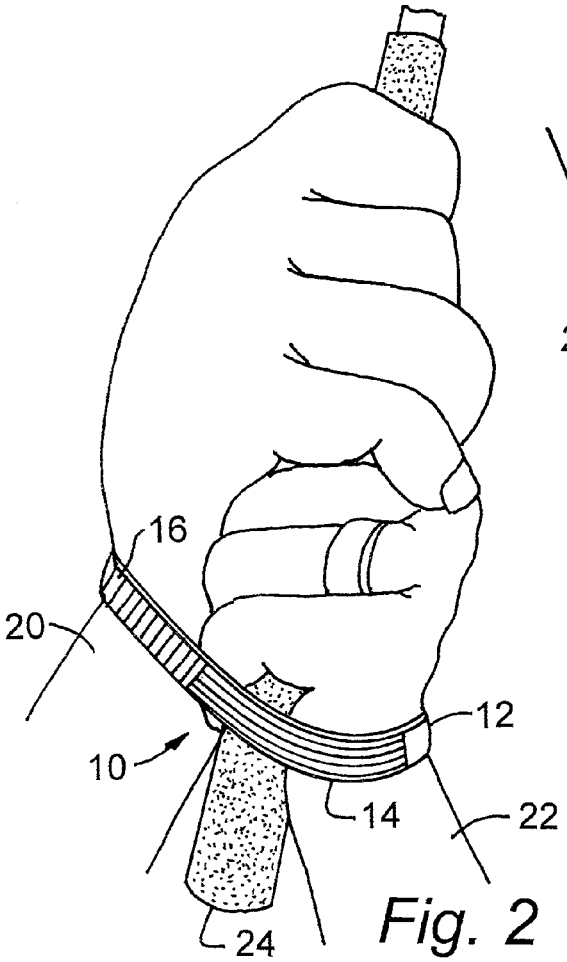
FIG. 2 is a view of a use of the golf swing aid of the present invention.
Figure 3:
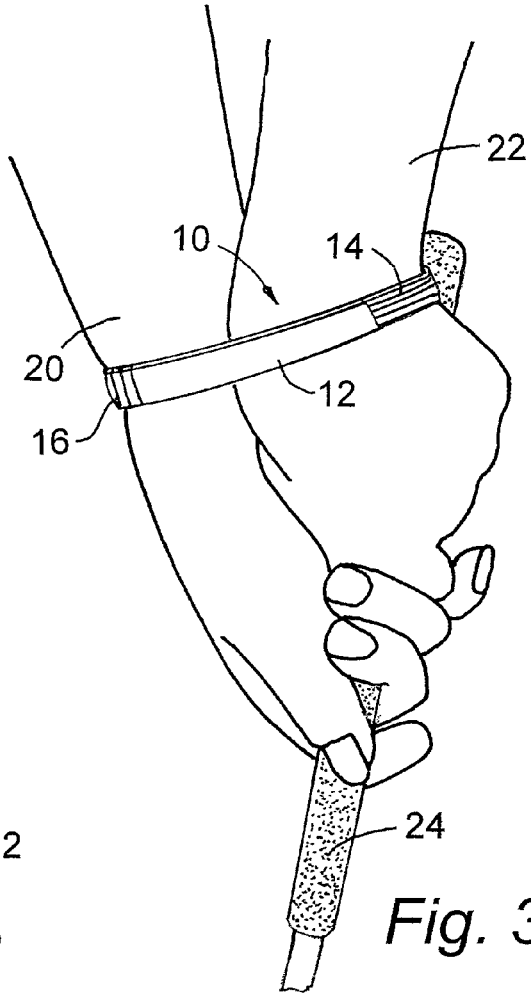
FIG. 3 is a view of a use of the golf swing aid of the present invention.

In FIGS. 2-3, the band 10 holds the golfer's wrist angles consistent and also keeps grip pressure consistent. With the wrists 20, 22 kept in place, the elbow distance of the golfer also remains consistent. With the band 10 wrapped around the wrists 20, 22, the golfer is required to use more of his or her body during the swing. Further, the band 10 wraps around the wrists 20, 22 to keep forearm separation at a minimum.

As shown in FIG. 1, the band 10 is divided into a plurality of regions, most generally identified by using three distinct colors, although it is contemplated that other ways of distinguishing the regions are possible, including three textures or three patterns. It is understood by one of ordinary skill in the art that two distinct regions may be used instead of three. By way of example, the band 10 is divided into three colored sections 12, 14, 16: white, blue, and red. The band fits securely around the wrists 20, 22 such that one color (red) 16, is on the right wrist, the second color (white) 12, is between the wrists, and a third color (blue) 14 is on the left wrist. The color regions 12, 14, 16 are typically about equal in length. In order to have the straightest swing, and avoid a hook shot or a slice, the colors should be in the same position upon impact with the ball as they were when lining up the shot. If the colors are not observed to be in the same position by impact, the shot will not be straight. The ball will curve to the left if the color that begins on top of the right wrist viewed to be on top at impact. Similarly, the ball will curve right if the color on the left wrist during setup is viewed to be on top at impact. Using these guidelines, the band 10 can also aid if the golfer if the golfer intends for the ball to curve in one direction or another.

When swinging, the golfer uses the color line up as a reference point. For the most consistent, straight shot, the golfer should see the same colors throughout the backswing, the swing, and the follow-through.

Figure 4:
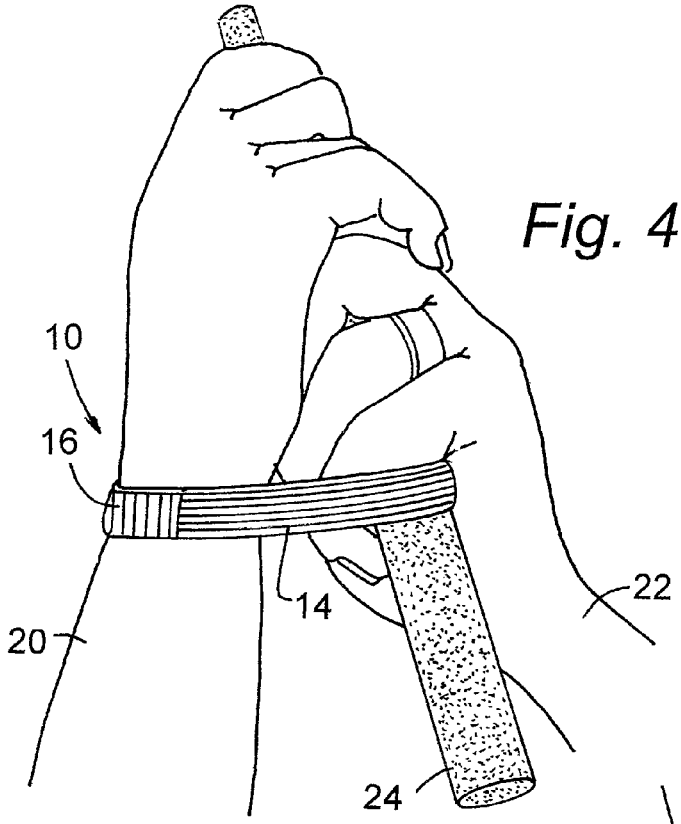
FIG. 4 is a view of a use of the golf swing aid of the present invention.
Figure 5:
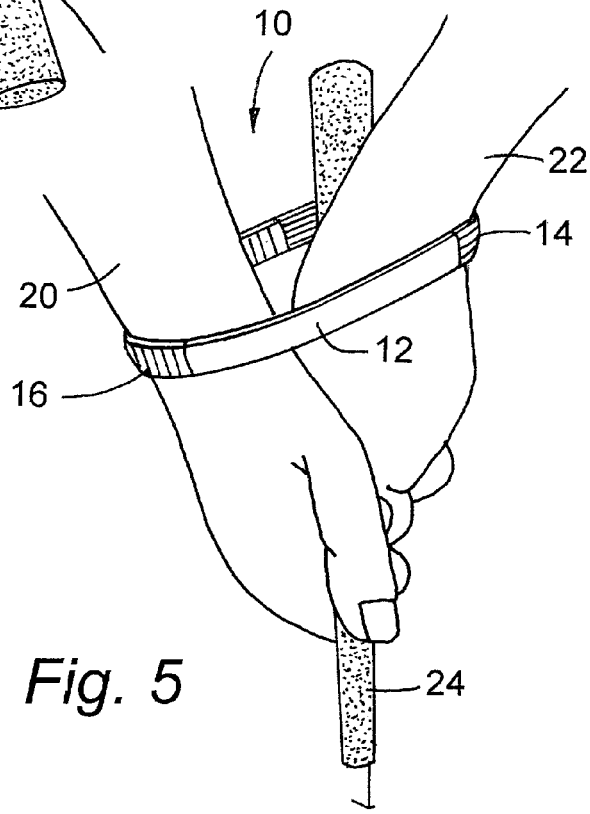
FIG. 5 is a view of a use of the golf swing aid of the present invention.

When the user places the band 10 around both wrists 20, 22 and the club 24, as shown in FIGS. 4-5, the band 10 has several positive effects on the swing. For example, the band 10 continues to help the wrists 20, 22 arch down post-impact, as needed in a release. Also, the band 10 prevents the hands from starting in a position that is too low by applying pressure to the back part of the grip in an upward direction until pressure becomes constant. Furthermore, the wrists 20, 22 at setup have more congruent angles, which prevents the right wrist 20 from working eccentrically (the forearm muscles are working in a way to prevent the wrist from bending further) in the initial stages of the golf swing. Additionally, the band 10 keeps grip pressure the same throughout the swing. The band 10 keeps the golfer's hands in place and keeps the wrist angles at the back of the hand and forearm from breaking down throughout the swing (which causes inconsistencies).

Figure 6A:
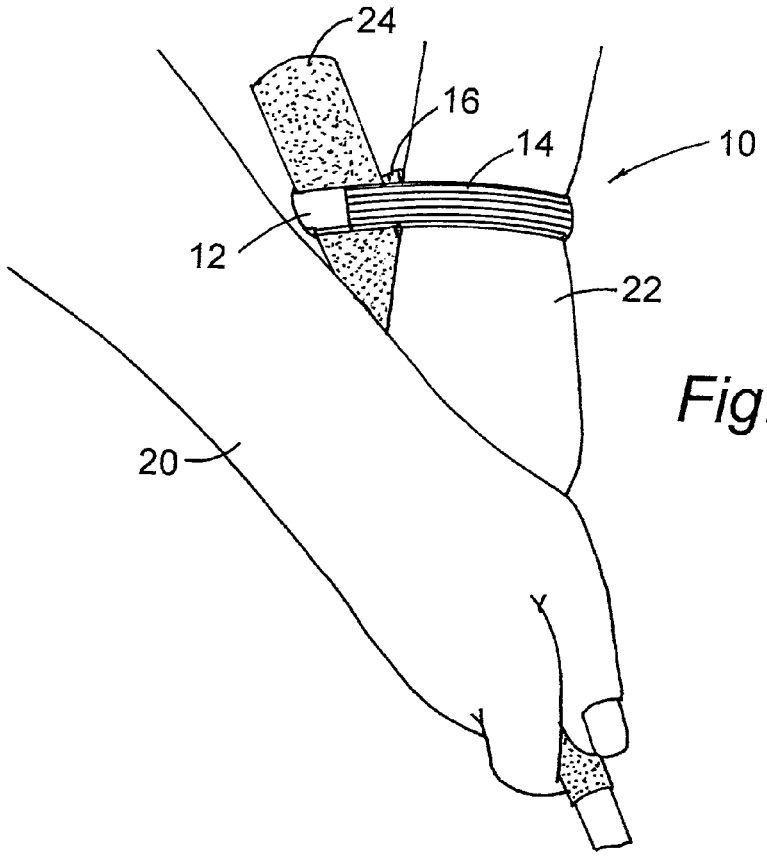
Figure 6B:
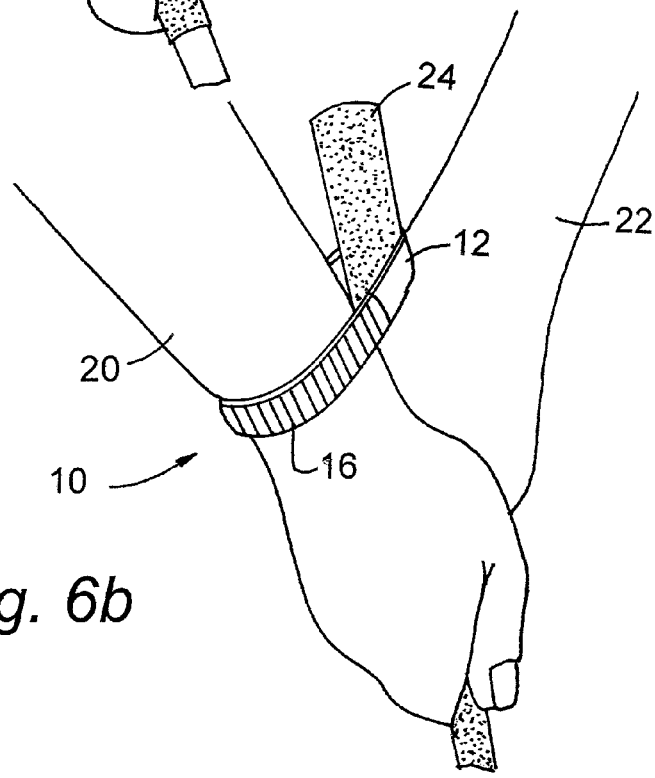

As shown in FIGS. 6*a*-6*b*, the band 10 can also be used around one wrist 20 and the club 24 during full swings, short game shots, and putting for stability in the arm and wrist 20. This also helps keep the clubface square.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

The invention claimed is:

1. A method for improving a golf swing comprising:

a) positioning a golf swing aid around both of a golfer's wrists, wherein said swing aid comprises a single, continuous band configured to fit securely around both of a golfer's wrists, wherein the band further comprises three visually distinct regions of generally equal lengths and one region lies on the right wrist, another region lies on the left wrist, and the third region lies between the wrists;

b) gripping the handle of a golf club;

c) swinging the club backward;

d) swinging the club forward; and e) observing the position of the regions of the band during the course of the swing.

2. The method of claim 1, wherein the region lying between the wrists is observed to be in the same position during the backward swing and the forward swing.

3. The method of claim 1, wherein the person observing the position of the regions of the band is the golfer.

4. The method of claim 1, wherein the club is within the band.

5. The method of claim 1, wherein each of the visually distinct regions is a different color.

6. A method for improving a golf swing comprising:

(a) positioning a golf swing aid around one or both of a golfer's wrists, wherein the swing aid comprises a single, continuous band configure to fit securely around one or both of a golfer's wrists and the band further comprises a plurality of visually distinct regions of generally equal lengths;

(b) gripping the handle of a golf club;

(c) swinging the club backward;

(d) swinging the club forward; and e) observing the position of the regions of the band during the course of the swing, wherein the person observing the position of the regions is the golfer.

7. The method of claim 6, wherein the club is within the single, continuous band.

8. The method of claim 6, wherein the band is placed around both of the golfer's wrists and one region of the band lies on the right wrist of the golfer and a second region lies on the left wrist of the golfer.

9. The method of claim 8, wherein the region lying on the right wrist and the region lying on the left wrist are observed to be in the same position during the backward swing and the forward swing.

10. The method of claim 6, wherein each of the visually distinct regions is a different color, a different texture, or a different pattern.

11. The method of claim 6, wherein each of the visually distinct regions is a different color.

12. The method of claim 6, wherein each of the visually distinct regions is marked with a different word.

* * * * *